US010584868B2

(12) United States Patent
Vrdoljak et al.

(10) Patent No.: US 10,584,868 B2
(45) Date of Patent: Mar. 10, 2020

(54) STEAM GENERATOR

(71) Applicant: SHARKNINJA OPERATING LLC, Newton, MA (US)

(72) Inventors: Ognjen Vrdoljak, Quebec (CA); Smith Shi, Shenzhen (CN)

(73) Assignee: SharkNinja Operating LLC, Needham, MA (US)

( * ) Notice: Subject to any disclaimer, the term of this patent is extended or adjusted under 35 U.S.C. 154(b) by 114 days.

(21) Appl. No.: 15/524,598

(22) PCT Filed: Nov. 4, 2015

(86) PCT No.: PCT/US2015/059119
§ 371 (c)(1),
(2) Date: May 4, 2017

(87) PCT Pub. No.: WO2016/073656
PCT Pub. Date: May 12, 2016

(65) Prior Publication Data

US 2018/0306432 A1 Oct. 25, 2018

Related U.S. Application Data

(60) Provisional application No. 62/074,741, filed on Nov. 4, 2014.

(51) Int. Cl.
*F22B 1/28* (2006.01)

(52) U.S. Cl.
CPC ..... *F22B 1/28* (2013.01); *F22B 1/282* (2013.01)

(58) Field of Classification Search
CPC ..... F22B 1/28; F22B 1/282; F22B 1/303
(Continued)

(56) References Cited

U.S. PATENT DOCUMENTS 1,356,818 A * 10/1920 Hadaway, Jr. ..... F24H 1/102 122/4 A
1,985,830 A * 12/1934 Powers ..... F24H 1/102 392/471

(Continued)

FOREIGN PATENT DOCUMENTS

EP 1165883 8/2003
WO 0058553 A2 10/2000

OTHER PUBLICATIONS

Chinese Office Action with English translation dated Oct. 25, 2018, received in corresponding Chinese Application No. 201580071311.X, 9 pgs.

(Continued)

*Primary Examiner* — William M McCalister
(74) *Attorney, Agent, or Firm* — Grossman Tucker Perreault & Pfleger, PLLC

(57) ABSTRACT

A steam generator to convert liquid into vapor having an inlet to receive liquid, a heating element, and an outlet to discharge vapor. The steam generator may further have a plurality of pathways to facilitate the flow of liquid or vapor through the steam generator. In one embodiment, one or more filter elements disposed in a chamber of the steam generator may help with preventing the buildup of precipitated particulates in the steam generator. In an embodiment, an exit conduit may be configured to further help with preventing particle buildup in the steam generator. In some embodiments, a body may have an inner and outer body and multiple chambers through which liquid or vapor passes as liquid or vapor travels through the steam generator.

19 Claims, 14 Drawing Sheets

(58) Field of Classification Search
USPC ..... 392/398
See application file for complete search history.

(56) References Cited

U.S. PATENT DOCUMENTS 2,051,880 A * 8/1936 Mekler ..... C10G 9/20 122/356
2,157,746 A * 5/1939 Armacost ..... F22G 7/14 122/240.1
2,505,170 A * 4/1950 Burnstein ..... F22B 1/287 122/39
2,518,270 A * 8/1950 Barr ..... B01J 8/1836 122/332
2,618,247 A * 11/1952 Mercier ..... F22B 1/22 122/127
3,279,534 A * 10/1966 Schwaiger ..... C12C 3/08 126/378.1
3,885,125 A * 5/1975 Palm ..... F24H 1/26 165/157
4,316,434 A * 2/1982 Bailey ..... F22B 27/12 122/20 B
4,395,618 A * 7/1983 Cunningham ..... H05B 3/82 165/160
4,401,101 A * 8/1983 Lunde ..... F24D 11/002 122/155.2
4,691,666 A * 9/1987 Scherer ..... A47J 27/17 122/33
4,878,458 A * 11/1989 Nelson ..... F22B 1/284 122/4 A
5,694,515 A * 12/1997 Goswami ..... F24H 7/0433 137/341
6,564,755 B1 * 5/2003 Whelan ..... F24D 12/02 122/20 B
6,701,069 B1 * 3/2004 Cezayirli ..... F24H 1/102 392/490
8,028,664 B2 * 10/2011 Kim ..... F22G 1/165 122/481
8,180,207 B2 * 5/2012 Shirai ..... E03D 9/08 392/465
8,364,029 B2 1/2013 Chen
8,463,117 B2 * 6/2013 Yeung ..... F24H 1/106 392/465
8,666,238 B2 * 3/2014 Wheeler ..... F24H 1/121 392/441
8,731,386 B2 * 5/2014 Waechter ..... F24H 1/009 392/479
8,755,679 B2 * 6/2014 Nishikawa ..... B01F 5/0451 392/386
9,014,548 B2 * 4/2015 Jang ..... F24H 1/0018 392/465
9,651,276 B2 * 5/2017 Ramirez ..... F24H 1/0018
2003/0024488 A1 * 2/2003 Bingham ..... F22B 1/1884 122/235.16
2004/0258403 A1 * 12/2004 Abras ..... F24H 1/162 392/480
2005/0072383 A1 * 4/2005 Powell ..... F22B 1/284 122/483
2011/0162594 A1 * 7/2011 Bruckner ..... F22B 15/00 122/7 R
2011/0274416 A1 * 11/2011 Chen ..... F22B 1/282 392/396
2012/0272927 A1 * 11/2012 Jonsson ..... F24D 11/002 122/19.1
2013/0048626 A1 2/2013 Seo et al.
2013/0058635 A1 * 3/2013 Vrdoljak ..... F22B 37/00 392/394

OTHER PUBLICATIONS

Search Report and Written Opinion dated Feb. 2, 2016 in PCT/US2015/059119.
PCT Search Report and Written Opinion dated Feb. 2, 2016, received in corresponding PCT Application No. PCT/US15/59119, 12 pgs.

* cited by examiner

STEAM GENERATOR

TECHNICAL FIELD

Aspects described herein generally relate to cleaning devices, more specifically, to a steam generator for converting water to steam.

BACKGROUND

In general, a steam appliance includes a steam generator for converting water to steam. During the conversion process calcium, magnesium, and other particles or mineral deposits may form causing blockage of the steam outlet. Disclosed is a steam generator capable of delivering good life expectancy by minimizing such blockage.

SUMMARY

In one embodiment, a steam generator includes a body having a first end and a second end, an inlet disposed about the first end, where the inlet is configured to receive water. The steam generator includes a plurality of pathways disposed within the body, where the pathways extend between the first end and the second end. The steam generator may include a heating element in communication with the plurality of pathways, the heating element capable of increasing the temperature of the water in the plurality of pathways so as to generate steam. In one embodiment, the steam generator includes an outlet disposed about the second end, where the outlet is configured to discharge the steam.

In one embodiment, the heating element of the steam generator can be formed of an aluminum material. In another embodiment, the plurality of pathways includes a first pathway that facilitates the flow of water and steam from the first end to the second end, and a second pathway that facilitates the flow of water and steam from the second end to the first end, whereby the first pathway and the second pathway are on opposite sections of the body.

In one embodiment, the steam generator further includes a thermostat disposed about at least one of the first end and the second end, the thermostat configured to sense the temperature of at least one of the water and the steam. In another embodiment, the steam generator further includes at least one of a first cover and a first gasket for the first end of the body, and at least one of a second cover and a second gasket for the second end of the body. In some embodiments, the outlet of the steam generator includes a conduit that extends into the second end of the body. In other embodiments, the conduit has a length of at least about 5 mm.

An exemplary embodiment of a steam generator may include a body, an inlet configured to receive fluid into the body, and a steam outlet extending at least partially into the body and configured to discharge steam from the body. The body may comprise a first chamber in fluid communication with the inlet, a second chamber, at least two initial pathways in fluid communication with the first chamber, the pathways extending to the second chamber, a heating element configured to transfer heat to the fluid passing through the at least two initial pathways, thereby converting at least a portion of the fluid to steam, and a filtering array of spaced pillars extending from a surface of the second chamber proximate to at least one second chamber exit, wherein the filtering array of spaced pillars define a plurality of overlapping fluid flow paths, and wherein the filtering array of spaced pillars are separated by a distance that results in solid particles being filtered out from the steam exiting toward the at least one second chamber exit.

In an embodiment, the body of steam generator may further include a third chamber in fluid communication with the at least one second-chamber exit, wherein the third chamber is configured to receive heat from the heating element so as to generate additional steam and a third chamber exit in fluid communication with the third chamber. In an embodiment, the body of steam generator may further include a fourth chamber comprising a fourth chamber entrance in fluid communication with the third chamber exit and a fourth-chamber exit in fluid communication with the steam outlet, wherein steam may be discharged from the fourth chamber through the outlet.

Other variations, embodiments and features of the present disclosure will become evident from the following detailed description, drawings and claims.

DETAILED DESCRIPTION OF THE DISCLOSURE

It will be appreciated by those of ordinary skill in the art that the embodiments disclosed herein can be embodied in other specific forms without departing from the spirit or essential character thereof. The presently disclosed embodiments are therefore considered in all respects to be illustrative and not restrictive.

Figure 1:
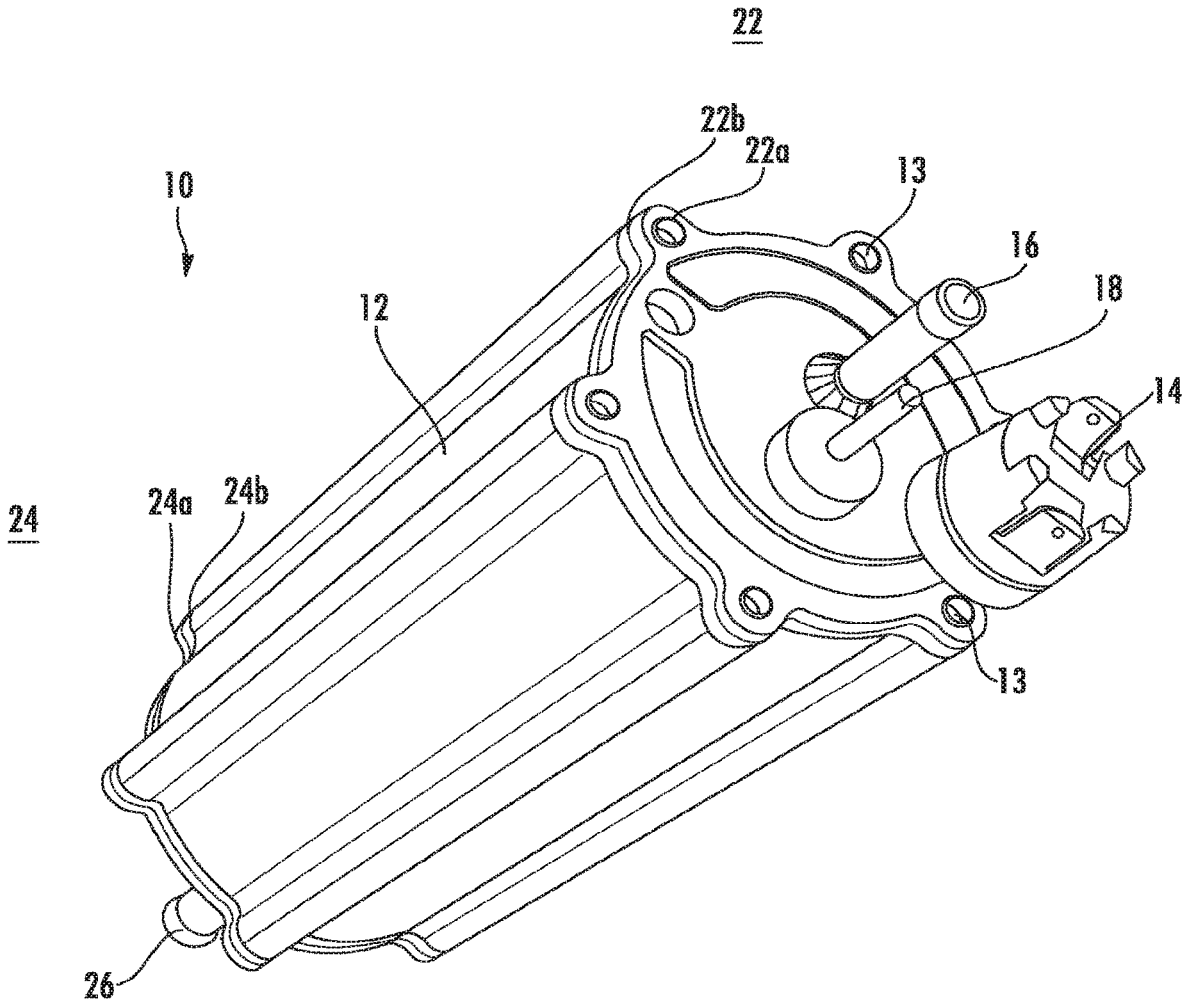
FIG. 1 is a perspective view of a steam generator as viewed from a first end.

FIG. 1 is a perspective views of a steam generator 10 according to one embodiment of the present disclosure. The steam generator 10 may also be referred to as a boiler. The disclosed steam generator 10 includes a body 12 having a first end 22 and a second end 24. In this instance, the first end 22 can be referred to as the top end while the second end 24 can be referred to as the bottom end. The first end 22 of the steam generator 10 includes an inlet 16 disposed thereabout, where the inlet 16 is capable of receiving water or a fluid medium. In some embodiments, the fluid medium may be a mixed, aqueous solution, among other types of liquids or fluids. In other embodiments, the mixed, aqueous solution may be a mixture of vinegar/water, detergent/water or cleaning solution/water, among other suitable cleaning mixtures.

Figure 3:
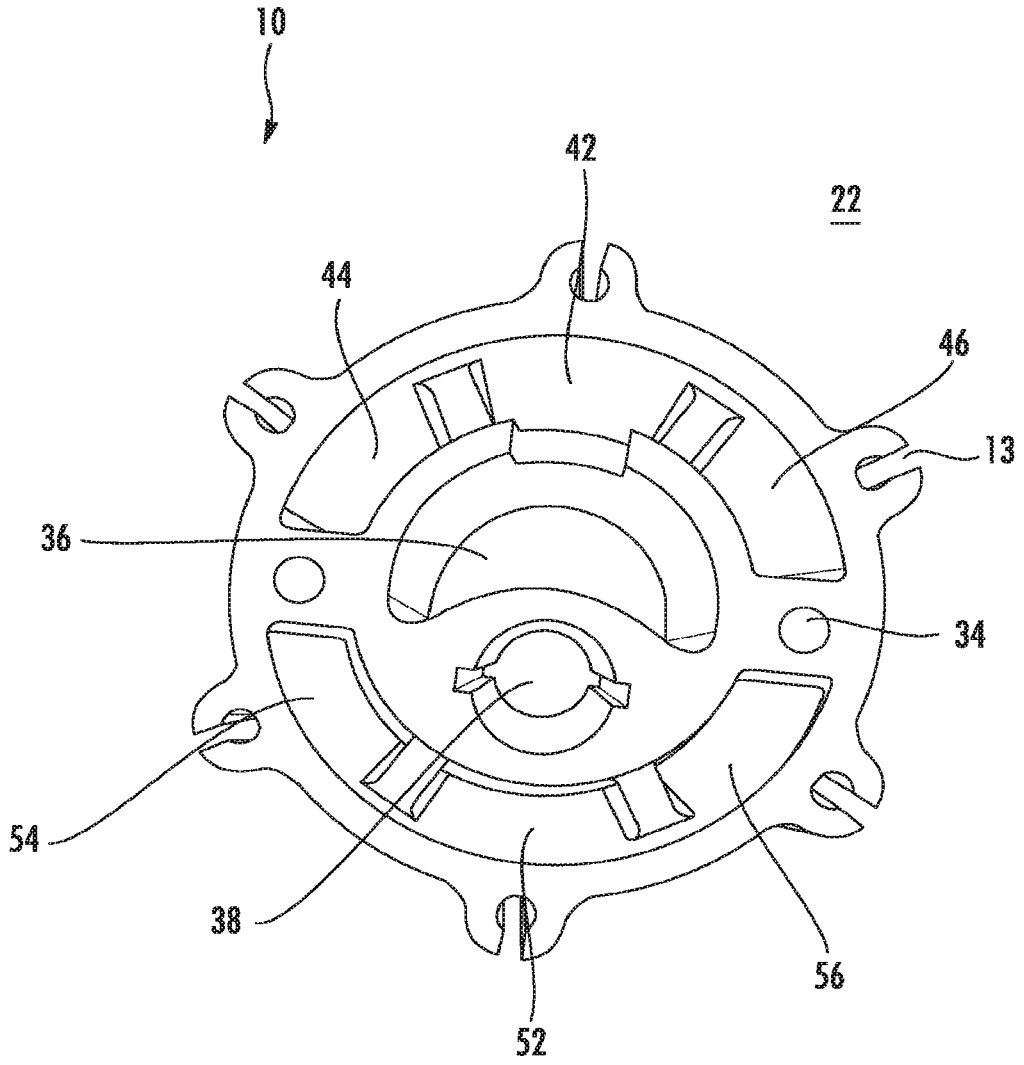
FIG. 3 is a cross-sectional view of the steam generator as viewed from the first end.

In one embodiment, as depicted in FIG. 3, the steam generator 10 includes a plurality of pathways 42, 52 disposed within the body 12, the pathways 42, 52 extending between the first end 22 and the second end 24. In some embodiments, the pathways 42, 52 can be tortuous with twists, turns and curves. A heating element 18 can be in communication with the plurality of pathways 42, 52, such that the heating element 18 is able to increase the temperature of the water in the plurality of pathways 42, 52 so as to convert the water into steam. In other words, the heating element 18 can generate steam. The built-in heating element 18 can be formed of an aluminum material. In other instances, the heating element 18 can be formed of copper or stainless steel, among other suitable types of material. In some embodiments, the heating element 18 (better illustrated in FIG. 8) can be powered via a pair of electrical contacts (not shown). In other embodiments, the heating element 18 is capable of converting a fluid medium into a vaporized medium.

In one embodiment, the steam generator 10 includes an outlet 26 disposed about the second end 24, where the outlet 26 is capable of discharging the vaporized medium, e.g., steam. In other words, water converted into steam by the heating element 18 can exit (e.g., expelled, discharged) the outlet 26. In another embodiment, the steam generator 10 also includes a thermostat 14 disposed about at least one of the first end 22 and the second end 24, the thermostat 14 configured to sense the temperature of at least one of the water and the steam. In the embodiment depicted in FIG. 1, the thermostat 14 is disposed about the first end 22.

Figure 2:
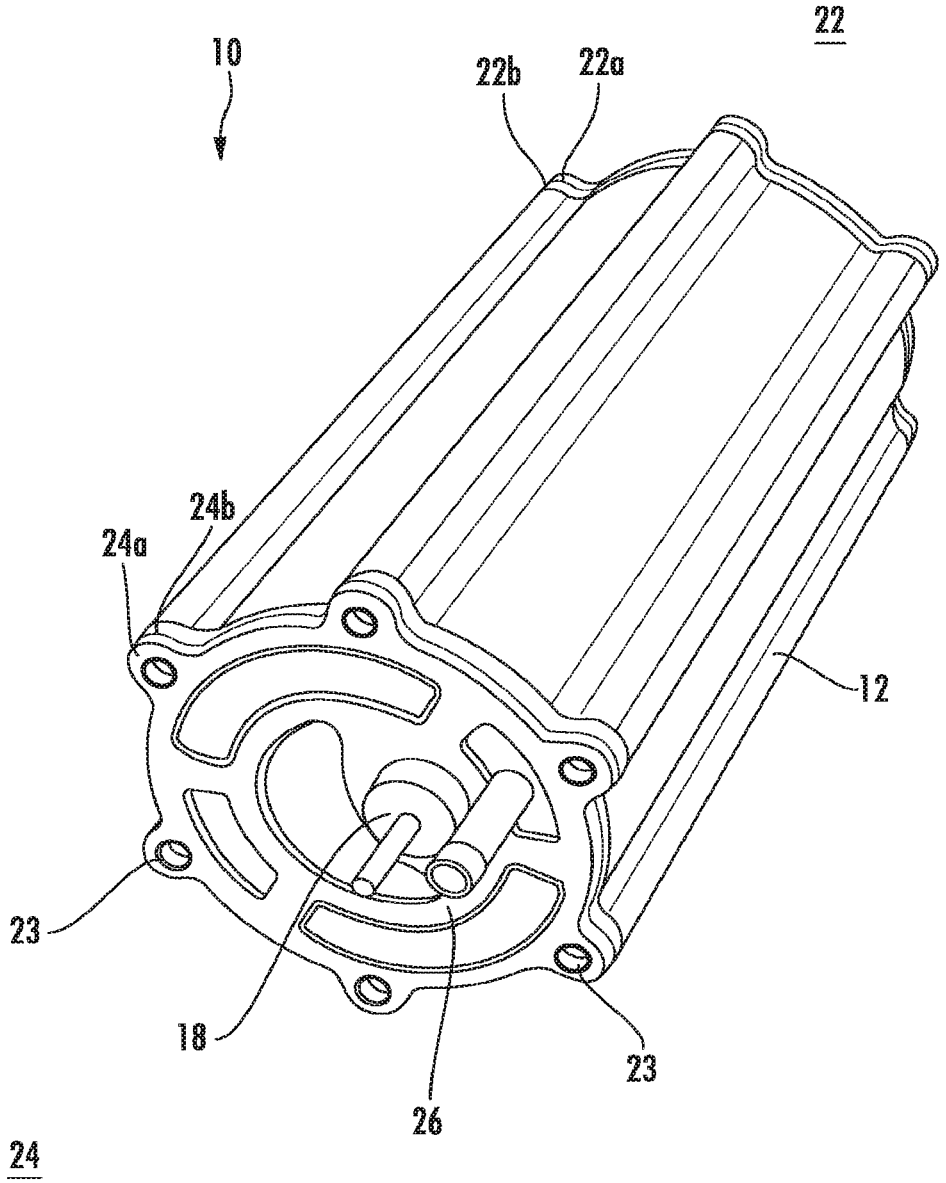
FIG. 2 is a perspective view of the steam generator as viewed from a second end.

As shown in FIG. 1, the first end 22 may include a cover 22*a* and/or gasket 22*b*. Similarly, the second end 24 may also include a cover 24*a* and/or gasket 24*b*. The cover 22*a* and/or gasket 22*b* may be secured to the first end 22 via a plurality of fasteners (e.g., screws) through a plurality of apertures 13. Likewise, the cover 24*a* and/or gasket 24*b* may be secured to the second end 24 via a plurality of fasteners (e.g., screws) through a plurality of apertures 23 as best shown in FIG. 2. In some embodiments, the apertures 13, 23 need not be necessary and the steam generator 10 can be integrally molded as a single unit. In other embodiments, the steam generator 10 can be modularly constructed, among other suitable fabrication methods.

Figure 10A:
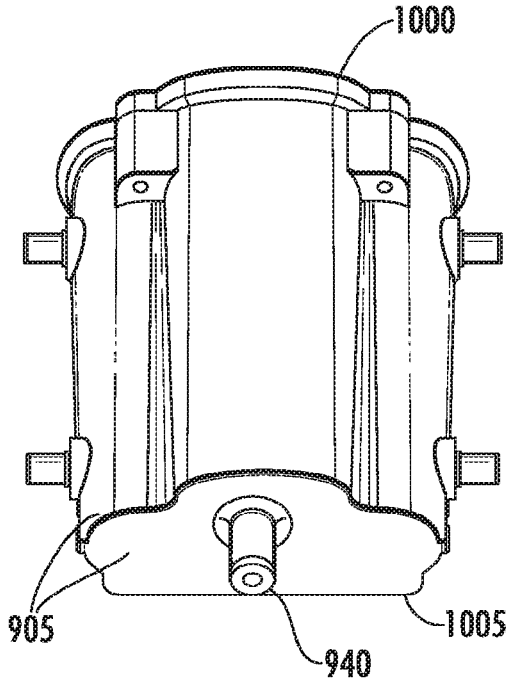
FIG. 10*a* is a perspective view of an outer body in FIG. 9.

One example of such an embodiment is depicted in FIG. 10*a*. In this embodiment the second-end cover has been produced integrally with an outer body 905 as one piece. However, in other embodiments other parts of the steam generator 10 may be integrally produced.

In some embodiments, the body 12 of the steam generator 10 may include a series of posts (not shown) on the outside of the body 12. The posts may help the steam generator 10 to be mounted within a steam appliance such as the likes of a steam mop or a handheld steamer, among others. Examples of steam appliances include those disclosed in U.S. Patent Application Nos. 2009/0320231 and U.S. Patent Application No. 2008/0066789, filed Jun. 27, 2008 and Jun. 27, 2007, respectively, each of which is incorporated herein by reference in its entirety for all purposes.

Figure 4:
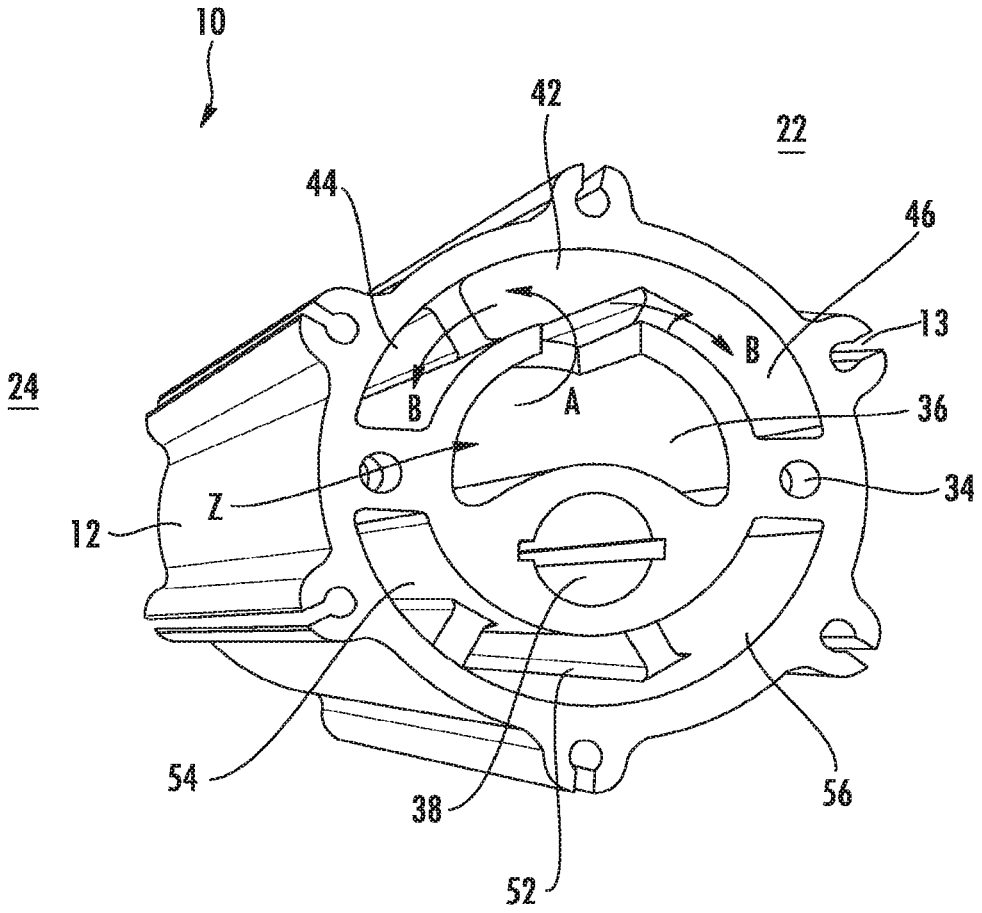
FIG. 4 is a perspective view of the steam generator as viewed from the first end.
Figure 5:
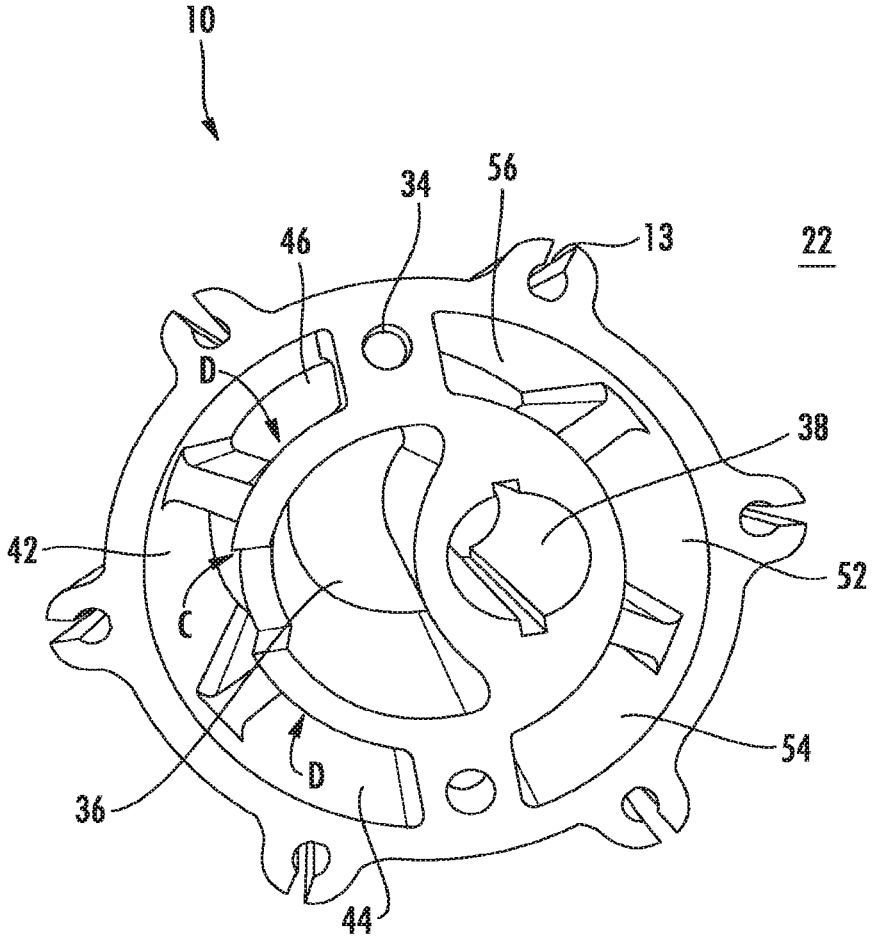
FIG. 5 is a cross-sectional view of the steam generator as viewed from the first end.

FIGS. 3-5 are cross-sectional and perspective views of the steam generator 10 as viewed from the first end 22 without the cover 22*a* or gasket 22*b* showing the plurality of apertures 13. As shown, the thermostat 14 has been removed revealing a cavity 34 for housing the thermostat 14. Similarly, the inlet 16 has been removed revealing a cavity 36 within the body 12 for housing the inlet 16. In some embodiments this cavity may extend from the first end 22 to the second end 24 of the interior of the steam generator 10. Likewise, the heating element 18 has been removed revealing a cavity 38 within the body 12 for housing the heating element 18. The interiors of the inlet 16 and the heating element 18 will be shown in more detail in subsequent figures.

In one embodiment, the diameter of the inlet 16 can be in the range of from about 1 mm to about 10 mm. In some embodiments, the diameter of the inlet 16 can be about 1.5 mm, or about 2 mm, or about 2.5 mm, or about 3 mm, or about 3.5 mm, or about 4 mm, or about 4.5 mm, or about 5 mm, or about 6 mm, or about 7 mm, or about 8 mm, or about 9 mm. In other embodiments, the diameter of the inlet 16 can be less than about 10 mm, or less than about 7.5 mm, or less than about 5 mm, or less than about 2.5 mm.

As shown, the interior of the body 12 of the steam generator 10 includes a plurality of pathways 42, 52. These primary pathways 42, 52 include adjacent secondary pathways 44, 46, 54, 56. In some embodiments there may be additional primary pathways. In operation, when water is introduced from the inlet 16 into the body 12 of the steam generator, the water exits the inlet 16 and rests primarily within the cavity 36, whose bottom is at the second end 24 or the steam generator. As the cavity 36 is filled with water the water subsequently moves from the second end 24 of the steam generator 10 towards the first end 22 as illustrated by arrow Z in FIG. 4. The water then moves into one of the pathways 42 through a pathway opening 43 as illustrated by arrow A. This primary or first pathway 42 facilitates the flow of water from the first end 22 back toward the second end 24 as best illustrated by arrow C, in FIG. 5. Overtime, as water is converted to steam, it is conceivable that steam may also be moved within this same pathway 42 from the first end 22 to the second end 24. In some instances, the water and/or steam may spillover to the secondary pathways 44, 46 as illustrated by the arrows B in FIG. 4. The water and/or steam within these pathways 44, 46 may also move from the first end 22 toward the second end 24 in a similar fashion as those in the primary pathway 42 as best illustrated by arrows D, in FIG. 5.

In some embodiments, the interior of the pathways 42, 44, 46 may include vanes (not shown) for guiding the fluid and/or vaporized mediums (e.g., water, steam). In operation, the fluid or vaporized mediums travelling within these pathways 42, 44, 46 may be guided or directed by the vanes. In some instances, the fluid or vaporized mediums may be influenced or perturbed by the vanes to produce additional agitation as it moves therein throughout. In some embodiments, the vanes can take on a patterned grid formation or have an organized orientation or alignment. In other embodiments, the vanes can be randomly distributed without any orientation or alignment. Alternatively, the vanes can have a combination of configuration, orientation and alignment.

In other embodiments, the vanes can create a vortex motion within the pathways 42, 44, 46, 62, 64, 52, 54, 56 of the steam generator 10. The cyclonic or vortex motion within the pathways 42, 44, 46, 62, 64, 52, 54, 56 can force precipitates or particles out of the flow path. In the alternative, the vortex motion may cause a fast moving flow path during the conversion of fluid medium to vaporized medium and create better cleaning action of the vaporized medium within the steam generator 10. In other words, fast moving steam may act as a cleaner and minimize the accumulation of mineral deposit particles. Any mineral deposit particles can be broken or disrupted by the fast steam motion and discharged through the outlet 26.

Figure 6:
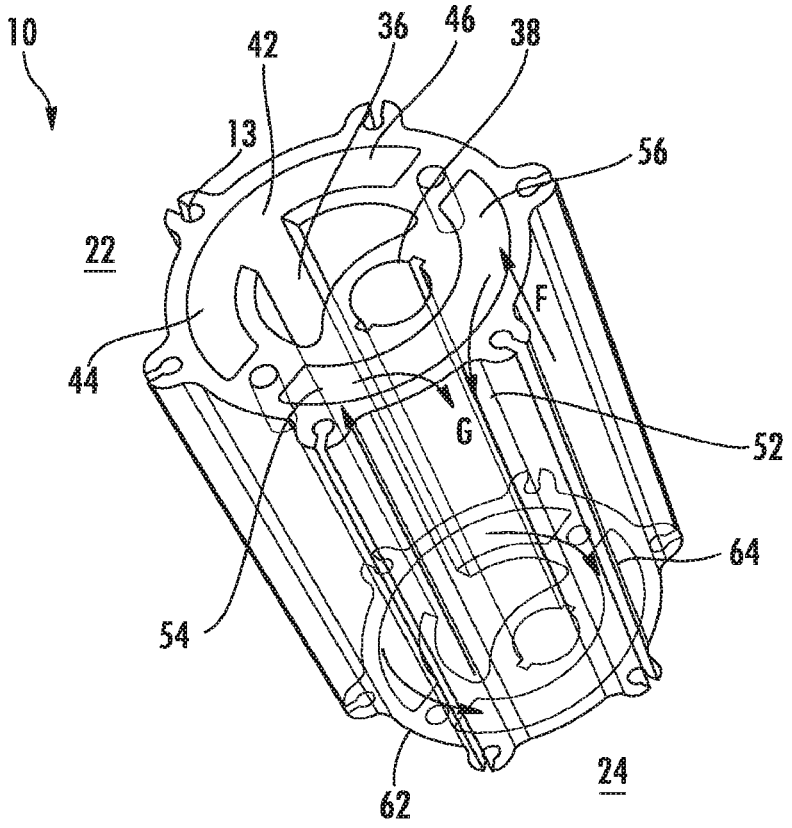
FIG. 6 is a perspective view of the steam generator as viewed from the first end.
Figure 7:
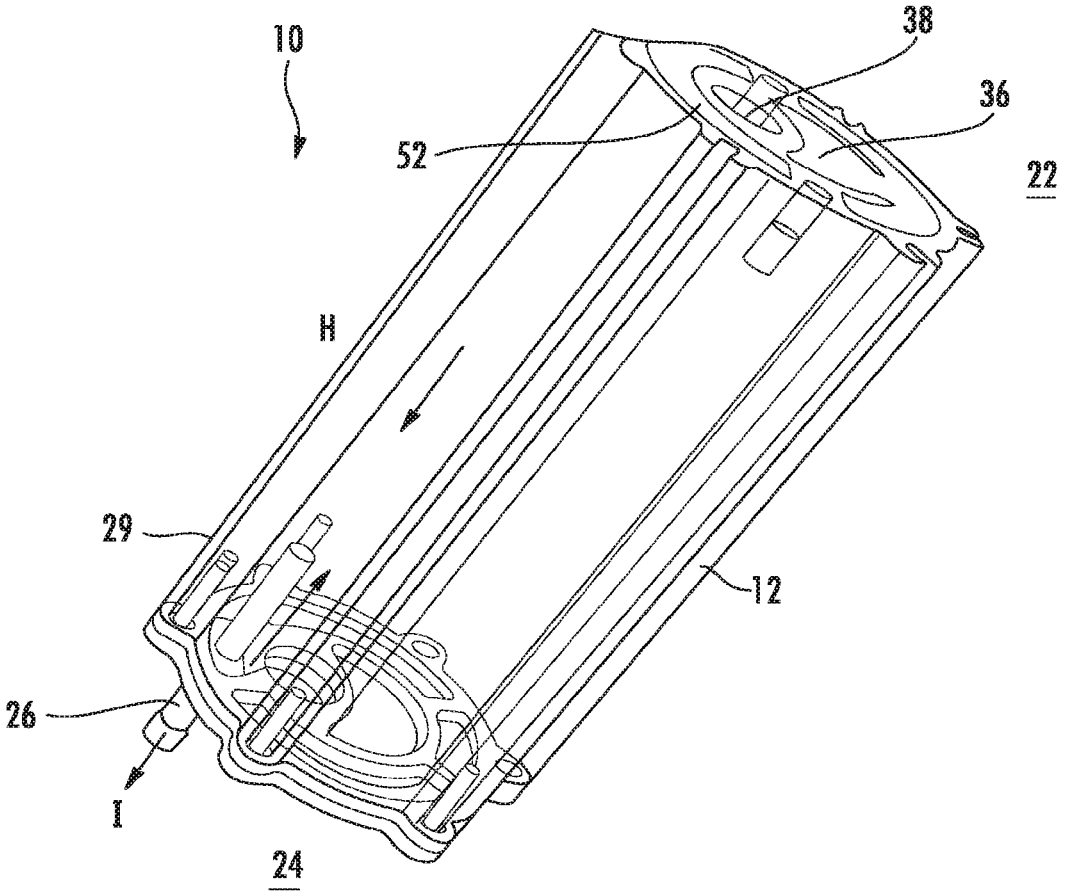
FIG. 7 is a side view of the steam generator.

FIGS. 6-7 are perspective and side views of the steam generator 10 as viewed from the first end 22 and from the side of the body 12. As the water and/or steam moves from the first end 22 toward the second end 24 through the pathways 42, 44, 46, they eventually reach and settle near the second end 24. The water and/or steam subsequently move along pathways 62, 64 near the second end 24 as best illustrated by arrows E, in FIG. 6. These pathways 62, 64 are in fluid communication with the pathways 42, 44, 46. The water and/or steam subsequently moves from the second end 24 toward the first end 22 through pathways 54, 56 in similar fashion from the earlier water/steam movements as best illustrated by arrows F, in FIG. 6. Once the water and/or steam have reached the first end 22, they converge and move into a primary or second pathway 52 as best illustrated by arrows G, in FIG. 6.

As the water and/or steam move into the primary or second pathway 52, they are able to move from the first end 22 toward the second end 24 as best illustrated by arrow H, in FIG. 7, similar to the earlier movements. In other words, there is a primary or second pathway 52 that facilitates the flow of water and/or steam from the first end 22 toward the second end 24, this primary or second pathway 52 being similar to that of the primary or first pathway 42 in terms of the direction and movement of the water and/or steam. In this embodiment, the primary or second pathway 52 is on the opposite side or section of the body 12 of the steam generator 10 from the primary or first pathway 42. As the water and/or steam moves through the primary or second pathway 52 as illustrated by arrow H, they are eventually discharged or able to exit from the outlet 26 as illustrated by arrow I.

Figure 8:
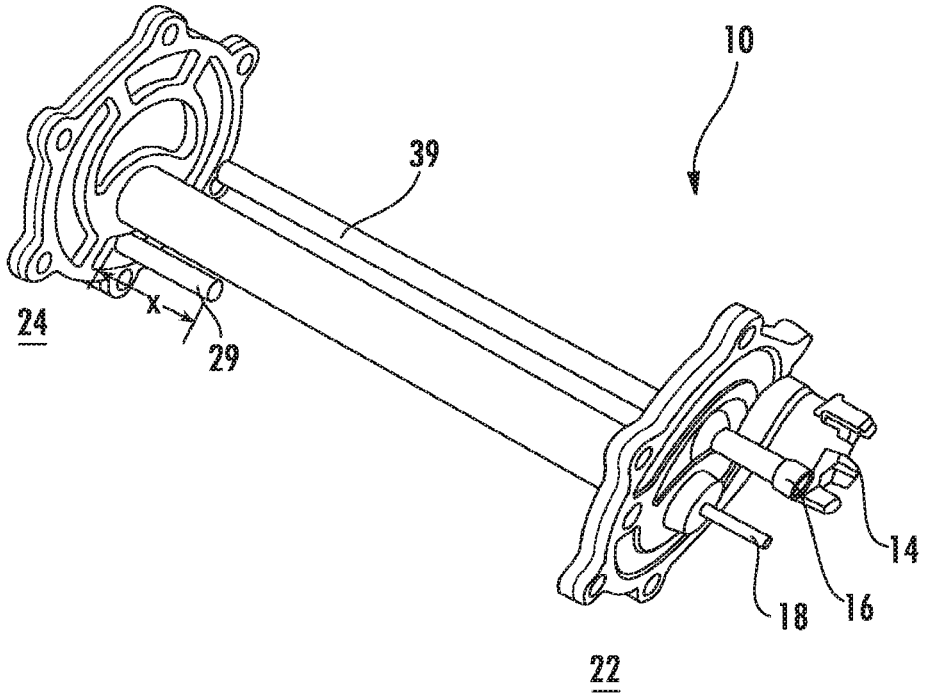
FIG. 8 is a deconstructed view of the interior of the steam generator.

FIG. 8 is a deconstructed view of the steam generator 10 with the various pathways 42, 44, 46, 62, 64, 52, 54, 56 removed along with the exterior of the body 12 to better illustrate the interior components. As shown, the inlet 16 includes a conduit 39 that extends from the first end 22 into the interior of the body 12 of the steam generator 10. Similarly, the heating element 18 extends through the entire body 12 of the steam generator 10 from the first end 22 to the second end 24. The disposition of the pathways network of pathway around and about the heater 18 promotes efficient heating of the liquid medium and conversion to vapor medium. In some instances, the heating element 18 need not extend throughout the entire length of the body 12 but instead can be housed within a portion of the body 12. In other instances, the heating element 18 can be powered via a pair of contacts (not shown). In operation, the heating element 18 is capable of delivering 1200 W of power, or 1300 W of power, or higher. In some embodiments, the heating element 18 can produce other power output levels. Although shown to be cylindrical in shape, the heating element 18 can have a U-shape with a 6 mm diameter. Alternatively, the heating element 18 can take on various shapes and sizes.

In one embodiment, the outlet 26 includes a conduit 29 that extends past the second end 24 and into the interior portions of the body 12. In other words, the conduit 29 enters the body 12 of the steam generator 10 by a certain length X (also shown in FIG. 7). In one embodiment, the length X of the conduit 29 is at least about 1 mm, or at least about 2 mm, or at least about 3 mm, or at least about 4 mm. In some embodiments, the length X of the conduit 29 is at least about 5 mm. The length X of the conduit 29 may be critical as it extends into the body 12 and is generally higher than the base portion of the second end 24 so as to minimize calcification.

Fluid medium such as water from residential or commercial water supply can leave particles including the likes of mineral deposits and salt residues, among others. These mineral deposits and salt residues may include calcium and magnesium, among other elements, compounds and minerals. In operation, the water or fluid medium may be delivered at a rate of about 25 grams per minute or 30 grams per minute. The water may also be delivered at other suitable delivery rates. The deposits or residues can precipitate out of the solution (e.g., water) as water is heated to steam. When the particles become too large, they may become trapped within the pathways 42, 44, 46, 62, 64, 52, 54, 56 of the steam generator 10. The extended length X of the conduit 29 may help to minimize calcification such that mineral deposits may occur near the base portion of the second end 24 so as to not block the outlet 26 from discharging steam therefrom.

In some embodiments, the steam generator 10 disclosed herein may or may not be pressurized. In other embodiments, the steam generator 10 can be oriented in vertical or horizontal orientations. Alternatively, the steam generator 10 can be oriented at multi-variable angles or in multi-variable directions/orientations when mounted within a steam appliance.

The steam generators 10 disclosed herein may have relatively small footprints (e.g., smaller in size, weight) so the units may be incorporated in a handheld steam apparatus such as a portable handheld steamer, among others, as described above. For example, the steam generator 10 can have a weight of not greater than about 500 grams, or not greater than about 400 grams, or not greater than about 300 grams, or not greater than about 200 grams, or not greater than about 100 grams.

Figure 9A:
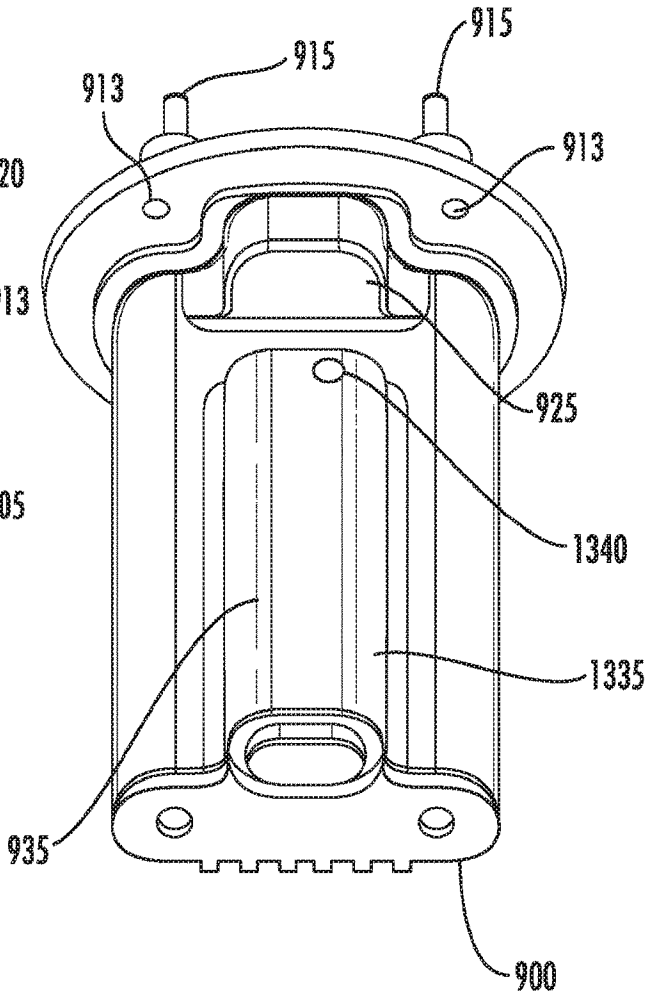
FIG. 9*a* is a perspective view of an inner body of the steam generator in FIG. 9.
Figure 9:
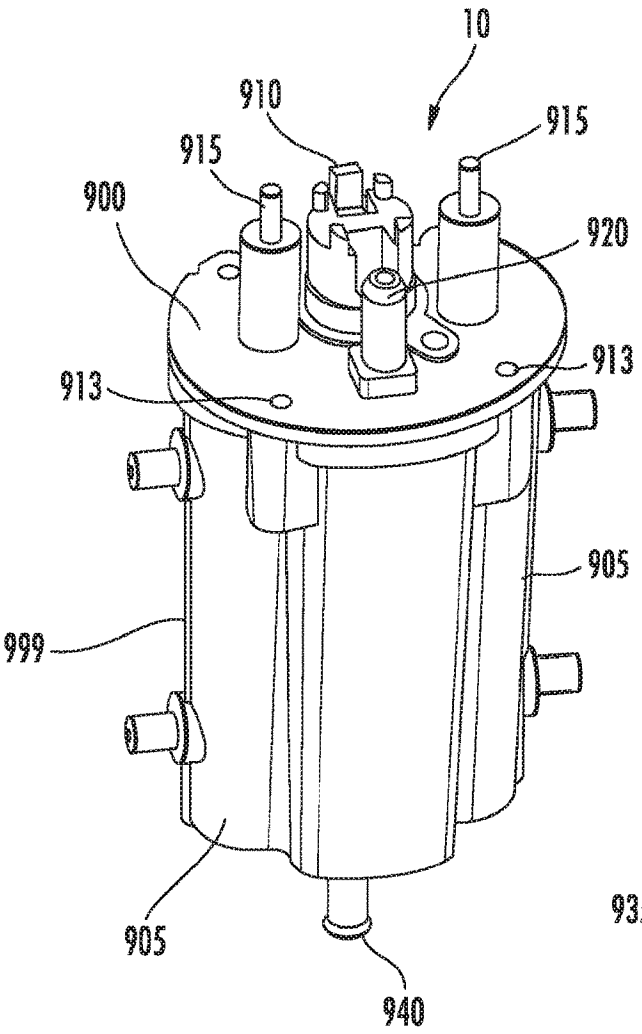
FIG. 9 is a perspective view of an embodiment of a steam generator.
Figure 9B:
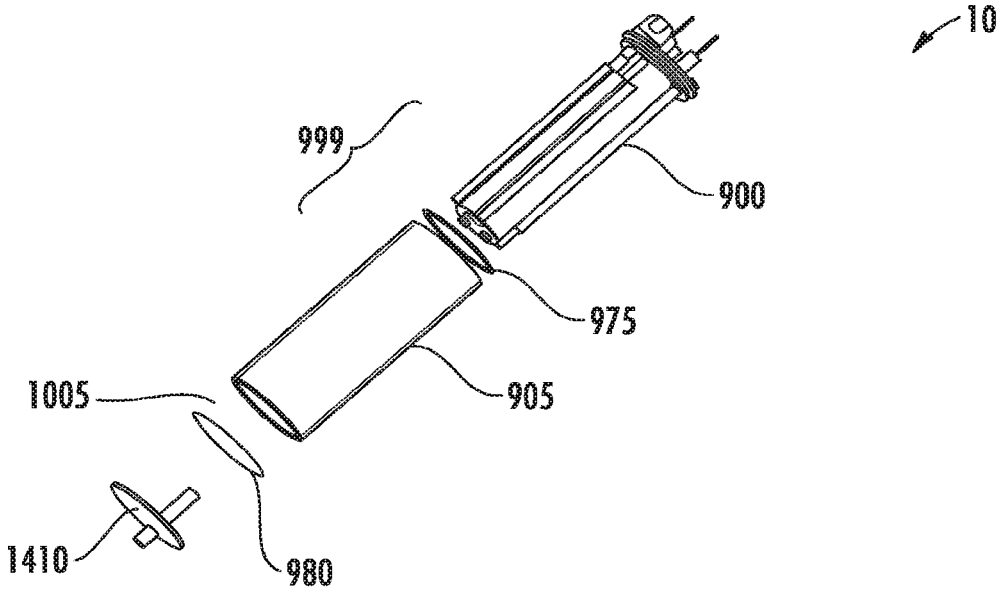
FIG. 9*b* is an exploded view of a modular steam generator.
Figure 16:
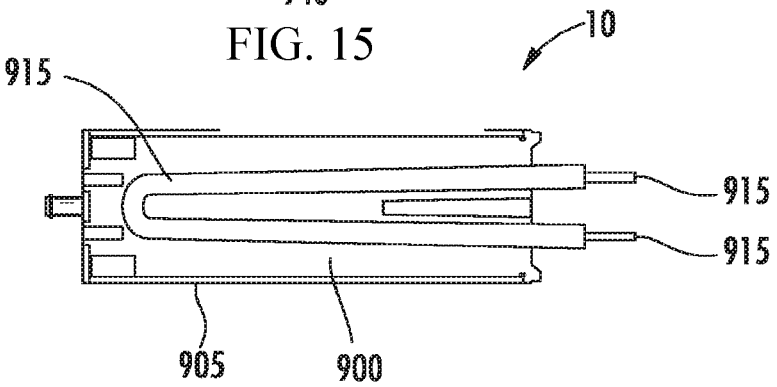
FIG. 16 is a cross-sectional view of an exemplary steam generator having a U-shaped heating element.

In another embodiment, as illustrated in FIGS. 9, 9*a*, and 9*b* the steam generator 10 comprises a body 999, a thermostat 910, a heating element 915, an inlet 920, and a steam outlet 940. The body 999 may include an inner body 900 and an outer body 905. Like the heating element in other embodiments of the present disclosure, the heating element 915 may have various shapes in different embodiments. For example, a cylindrical shape may be utilized. Other embodiments may use a U-shaped heating element. FIG. 16 depicts one embodiment utilizing a U-shaped heating element.

Figure 10B:
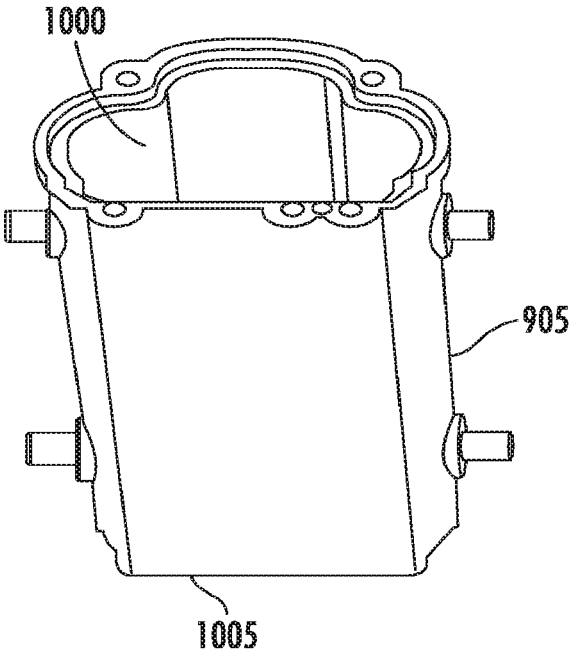
FIG. 10*b* is a perspective view of the outer body in FIG. 10*a* viewed from a different perspective.
Figure 10C:
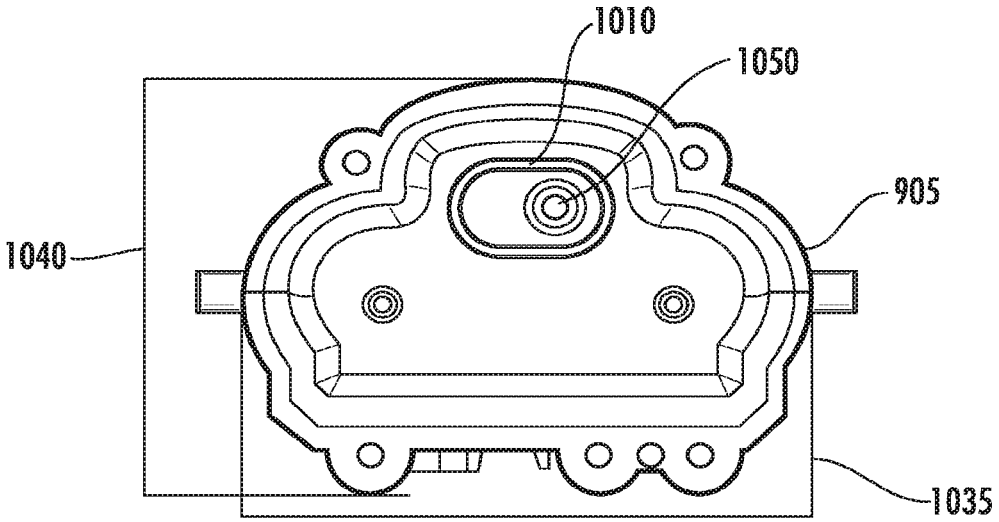
FIG. 10*c* is a top view of the outer body in FIG. 10*a;*

One embodiment of the outer body 905 is depicted in more detail in FIGS. 10*a*, 10*b* and 10*c*. As can be seen in FIG. 10*a*, the outer body may have an open end 1000 and a closed end 1005, and the inner body 900 may have a first end 1100 and a second end 1105, which can be seen in FIG. 11. In the embodiment, the steam generator 10 is configured so the inner body 900 can be seated at least partially inside the outer body 905. In this arrangement, the second end 1105 of the inner body 900 may be oriented towards closed end 1005 of the outer body 905, and the first end 1100 of inner body 900 may be oriented towards the open end 1000 of the outer body 905. The depiction in FIG. 9 shows this embodiment after the inner body 900 and the outer body 905 have been connected.

The inner body 900 and outer body 905 may be integrally formed or removably connected. As can be appreciated by one skilled in the art, the inner body 900 and the outer body 905 can be connected together in a variety of ways. In one embodiment, the inner body 900 and the outer body 905 may comprise corresponding sets of apertures 913. And the inner body 900 may be, secured to the outer body 905 by using the sets of apertures 913 with a fastener, such as a screw [not shown]. However, in other embodiments, fasteners may not be necessary because the inner body 900 and the outer body 905 could be molded out of a single unit. Or, in the alternative, they could be manufactured out of modular parts.

Figure 14:
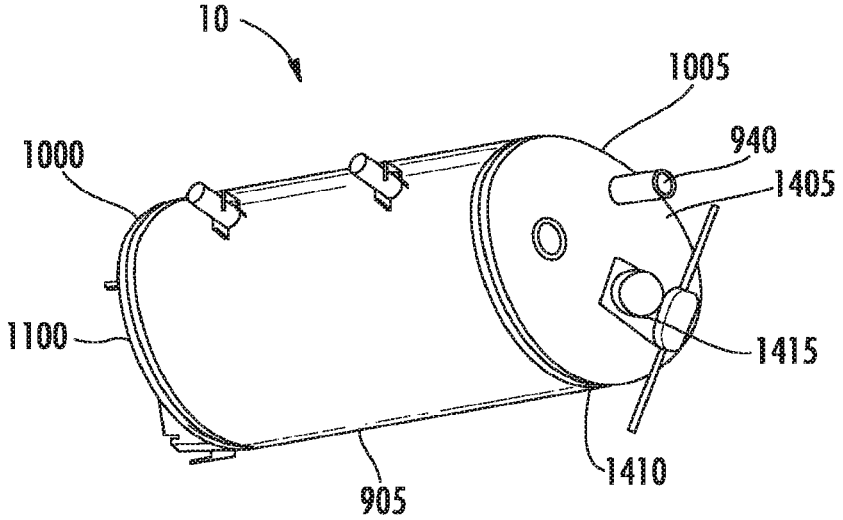
FIG. 14 is a perspective view of an exemplary embodiment of a steam generator.

In an exemplary embodiment, the closed end 1005 of the outer body 905 may include a second-end cover 1405 removably connected to or integrally formed with the body 905. One example of such an embodiment is depicted in FIGS. 9*b* and 14. In an embodiment, a sealer 1410 may also be employed to seal any gap that may exist between the second-end cover 1405 and the body 905 when they are removably connected. The sealer 1410 may include a gasket, adhesive, or other technology known in the art. The second-end cover 1405 may be connected to the outer body 905 by a number of ways including interference or compression fit, a set of corresponding apertures [not shown] and a screw 1415, or screws 1415.

An exploded view of an exemplary modular embodiment of the steam generator 10 is depicted in FIG. 9*b*. In this embodiment, the steam generator 10 has an inner body 900, an outer body 905, and a second-end cover 1410 being removably connected as illustrated. A first-end gasket 975 may be disposed between the inner body 900 and the outer body 905 to seal the connection therebetween. A second-end gasket 980 may be disposed between the outer body 905 and the second-end cover 1410 to seal the connection therebetween. In other embodiments, like shown in FIG. 10*a*, the closed end 1005 and the outer body 905 may be integrally formed so no cover or gasket is included. In some embodiments, the inner body 900 may also include modular parts.

It is to be appreciated that embodiments with a modular closed-end 1005, as described above, may facilitate manufacturing and assembly of the steam generator 10. An integrally formed closed-end 1005 may be manufactured using a molding process whereas a modular closed-end 1005 allows the body 905 to be manufactured using a more efficient, assembly line process. However, an integrated, closed-end 1005 design may be preferred in other situations and offers some advantages like reduction of parts and sources of leakage.

Figure 11:
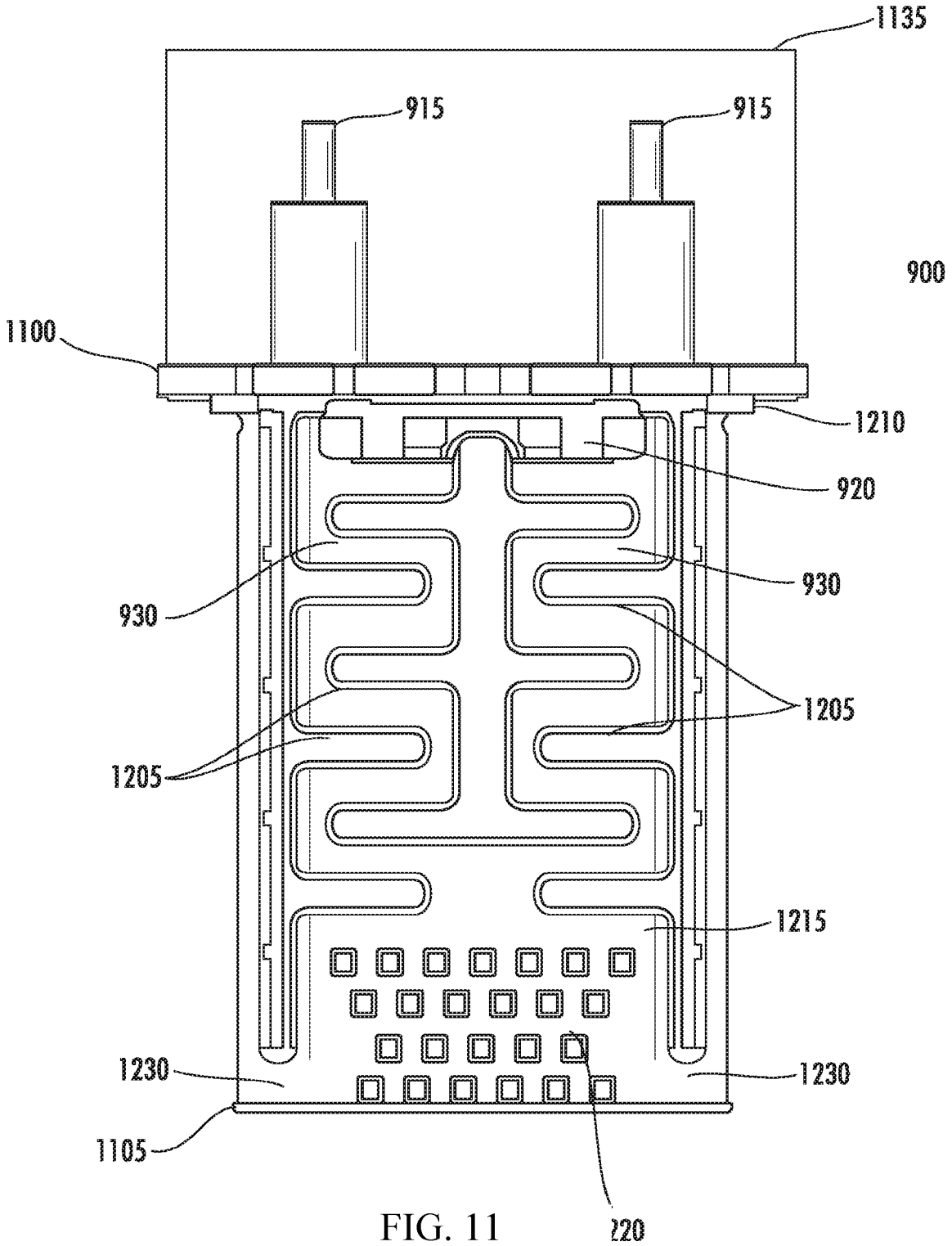
FIG. 11 is another perspective view of the inner body in FIG. 9*a;*
Figure 15:
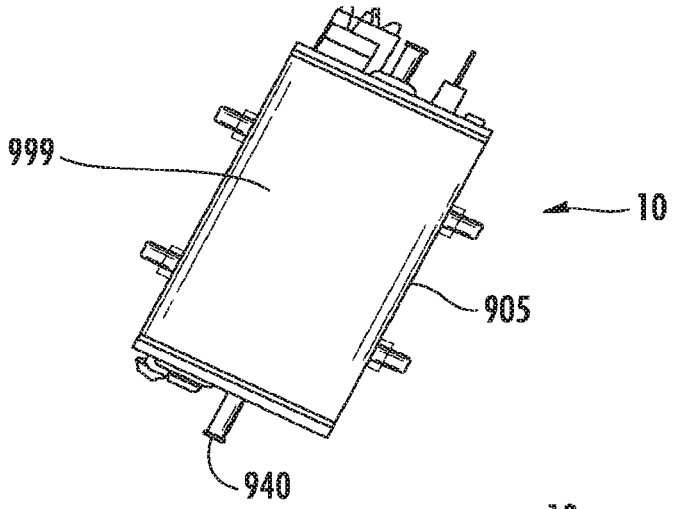
FIG. 15 is another perspective view of the steam generator of FIG. 14.

In some circumstances, connecting the inner body 900 to the outer body 905 may create undesired space between the inner body 900 and the outer body 905 due to draft angles of parts produced by a molding process. Excess space may compromise a seal, which may reduce the heat transfer to fluid in the steam generator 10 and thus reduce steam generation performance. An improved seal may be allowed by configuring the inner body 900 and the outer body 905 to be connected by compression fitting. An exemplary embodiment is depicted in FIG. 15. In such an embodiment, a diameter of the inner body 900 may be greater than a diameter of the outer body 905. The inner body 900 and outer body 905 may have a wall thickness that impart enough flexibility to the inner and outer bodies 900, 905 to allow for a tight compression fit when the larger inner body 900 is disposed at least partially inside the outer body 905. It is to be appreciated that the term "diameter" as used herein may refer to any suitable distance across the widths of the inner and out bodies 900 and 905, such as widths 1035, 1040, and 1135 as depicted in FIGS. 10*c* and 11. Other suitable measurement may also be used as the diameter measurement in accordance with the principles disclosed herein. The difference between the diameter of the inner body 900 and the outer body 905 may vary depending on the flexibility of the inner and outer bodies 900, 905. In an embodiment, to allow for a tight compression fit, a diameter of the inner body 900 may be greater than a diameter of the outer body 905 by about 0.05% to 5%. In another embodiment, a diameter of the inner body 900 may be greater than a diameter of the outer body 905 by about 0.1% to 2.5%. In another embodiment, a diameter of the inner body 900 may be greater than a diameter of the outer body 905 by about 0.5% to 1%.

After compression fitting, the inner body 900 and outer body 905, may be tightly connected, as depicted in FIG. 14. As can be seen in FIG. 14, the inner body 900, and the outer body 905 are fit together flush. A compression-fit steam generator 10 may also be manufactured out of additional types of materials, such as but not limited to stainless steel. In an embodiment, a tight compression fitting may be achieved more efficiently and consistently by a generally cylindrical shape of the inner and outer bodies 900 and 905. And, as discussed above, the first end 1100 and closed end 1005 may comprise covers that integrally produced with the inner body 900 and outer body, or be separate parts connected to the first end 1100 and second end 1005 by any means known in the art such as with apertures, screws, and gaskets.

In some embodiments, the inner body may further comprise the inlet 920 to receive fluid, as depicted in FIG. 9. In this embodiment, the inlet 920 provide an entrance for fluid to enter the steam generator 10. The inlet feeds the fluid to a first chamber 925, which can be seen in FIG. 9*a*. In some embodiments, the inlet 920 and the first chamber 925 may be part of the inner body 900. However, in other embodiments, one or the other, or both, may be independent parts, or in other embodiments, they may be part of the outer body 905. Once fluid gets to the first chamber 925, the heating element 915 may begin to heat the fluid.

The first chamber 925 also serves to separate the thermostat 910 from the heating element 915 to slow down the transfer of heat to the thermostat 910 and related cycling. In some embodiments, the steam generator 10 may be configured so that the heating occurs more quickly when the steam generator 10 is at an incline towards the heating element 915. In such an embodiment, the heating element 915 may be in closer communication with the fluid in the first chamber 925 resulting in a faster transfer of heat.

In some embodiments, the heating element 915 may extend through the inner body 900. This positioning may insulate the heating element 915 inside the inner body 900 and the outer body 905 and increase the efficiency of the steam generator 10.

In some embodiments, the first chamber 925 may be in fluid communication with at least two initial pathways 930, as shown in FIG. 11. In some embodiments, each pathway 930 may wind a tortuous route from the first end 1100 of the inner body 900 to the second end 1105 of the inner body 900.

The heating element 915 may communicate heat to the route. And the winding nature of the pathways 930 may extend the time period that the fluid is being heated. This may result in more steam be produced more efficiently.

The dual initial pathways 930 also improve the consistency of steam production. As can be appreciated, the steam generator 10, in operation, may be rotated one direction or another while a user maneuvers the cleaning device in one direction or another for cleaning. If a steam generator 10 has only one path, steam production can be compromised if the steam generator is rotated to a position where gravity pulls fluid away from the pathway. By introducing a second pathway 930, fluid is given additional route so more consistent steam production can be achieved. In alternative embodiments, the steam generator 10, may include more than two initial pathways.

Figure 12:
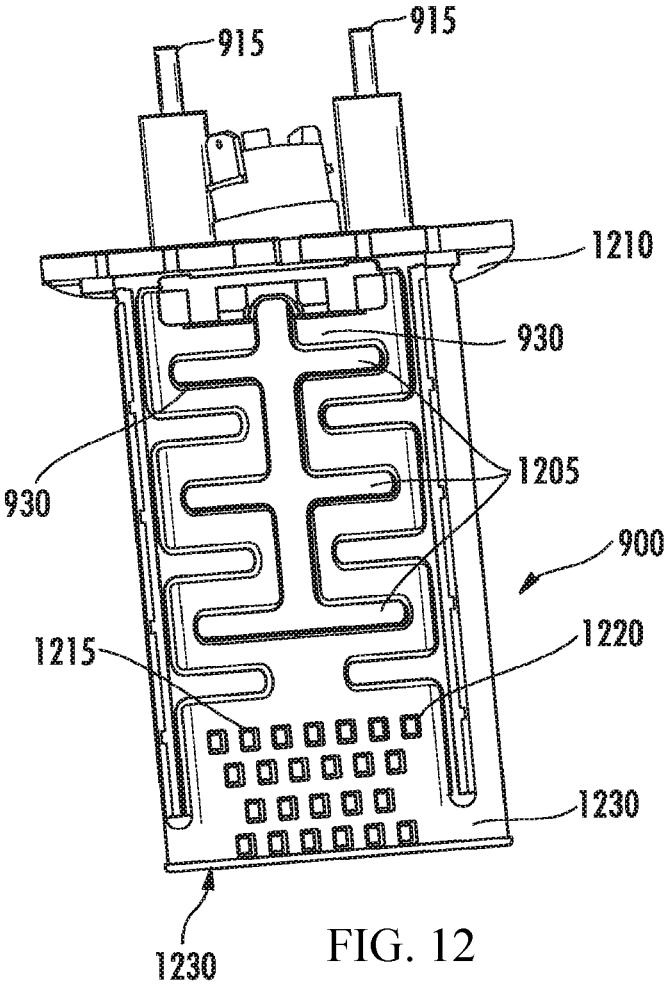
FIG. 12 is yet another perspective view of the inner body in FIG. 9*a;*
Figure 13:
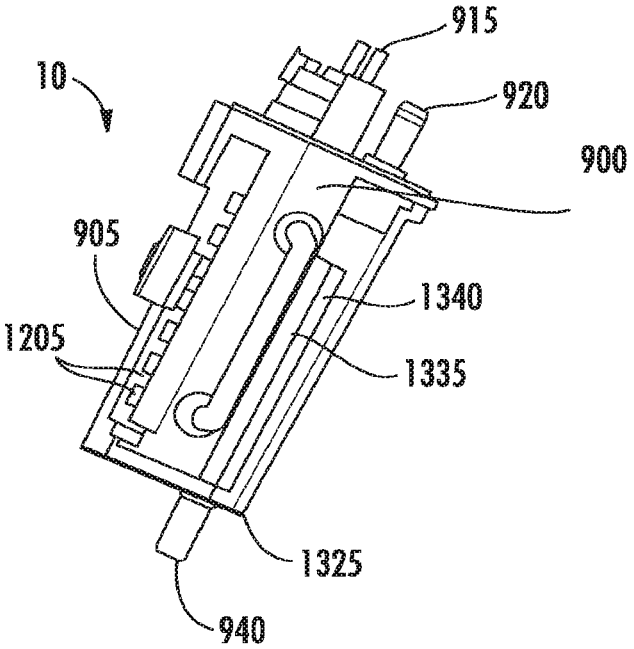
FIG. 13 is a perspective view of the steam generator in FIG. 9 showing the inner body and outer body being connected.

In some embodiments, the initial pathways 930 may be defined by the union of the inner body 900 and the outer body 905. One such embodiment is depicted in FIGS. 12 and 13. In such an embodiment, the inner body 900 may comprise the walls 1205 of the initial pathways 930, as depicted in FIG. 12. Before the inner body 900 is connected to the outer body 905, the pathway 930 may have no ceiling. However, the steam generator can be configured so that the ceiling is provided by the outer body 905, once it is connected to the inner body 900. One example of this embodiment is shown in FIG. 13. As discussed above, a variety of methods may be employed to connect the inner body 900 to the outer body 905 including compression fitting, or screws. Sealers 1210 can also be adhered at the contact point between the inner body 900 and the outer body 910. These sealers 1210 can comprise gaskets, adhesive gaskets, or other devices known in the art.

In other embodiments, the initial pathways 930 may be defined at least partially by the inner body 900. And, in other embodiments the initial pathways 930 may be defined at least partially by the outer body 905. In still other embodiments, the walls 1205 of the initial pathways may be defined at least partially by the outer body 905 and the ceiling at least partially defined by the inner body 900.

In some embodiments, the initial pathways 930 may intersect at a second chamber 1215. The second chamber 1215 may comprise an independent part, or similar to the initial pathways 930 it may be defined by the union of the inner body 900 and the outer body 905. The second chamber 1215 further comprises at least one second-chamber exit 1230. And in some embodiments comprises two, three or more second chamber exits 1230.

In some embodiments, the second chamber 1215 may also include a plurality of spaced-apart members 1220. These function as a filter structure 1225. The members 1220 may be formed of pins, posts, or pillars extending from one of the surfaces of the second chamber 1215.

Liquids such as water from residential or commercial water supplies may contain dissolved minerals or other matter than can form deposits on the inner surfaces of the steam generator 10 from the heating of the liquid to vapor (e.g., water to steam). Typical minerals contained in water include calcium and magnesium, among other elements, compounds and minerals. The deposits or residues can precipitate out of the solution (e.g., water) as it is heated to vapor. Typically, the precipitates themselves are much smaller than the opening of the second-chamber exit 1230 so they are discharged with the vapor and do not build up or otherwise cause clogging. However, larger particles can be created in the form of deposited material that has been freed from the inner surface during operation and that is carried by the liquid and vapor toward the second-chamber exit 1230. Also, even the smaller precipitates themselves can cause buildup right at the outlet chamber exit over time, causing partial or complete blockage and degraded operation of the steam generator 10.

The array of members 1220 provide the above-discussed filtering with increased surface area by virtue of extending across a relatively wide area in the vicinity of the chamber exit 1230 and creating a large number of overlapping paths through which the vapor can travel toward the chamber exit 1230. Any small number of spaces between members 1220 may become clogged without substantially reducing the ability of the vapor to travel to the outlet second-chamber exit 1230. The vapor may naturally be directed around such clogs toward open spaces and paths through the members 1220 to the second-chamber exit 1230. It is only when most of these spaces become clogged that performance may degrade significantly, and the time period required to clog the second-chamber exit 1230 may be much greater than it would be if no filtering were taking place.

The spaces between the members 1220 can vary in different embodiments. In some embodiments, the members 1220 may be spaced apart by a uniform distance. But in other embodiments, the spacing between the members 1220 may vary. In one embodiment, the spacing between the members is smaller than the second-chamber exit 1230. Potentially-clogging particles larger than the diameter of the second-chamber exit may be trapped by the members 1220, but particles small enough to pass through the second-chamber exit may not.

In some embodiments, the members 1220 can take on a patterned grid formation or have an organized orientation or alignment. In other embodiments, the members 1220 can be randomly distributed without any orientation or alignment. In other embodiments, the members 1220 can have a combination of configuration, orientation and alignment.

After the fluid and steam is discharged from the second chamber 1215, it may enter the third chamber 1325. One embodiment of the third chamber is shown in the depiction in FIG. 13. In some embodiments the third chamber 1325 may be defined by the union of the inner body 900 and the outer body 905, similar to the second chamber 1215 and the initial pathways 930. In other embodiments, the third chamber 1325 may be an independent part or it may be defined wholly by the inner chamber 900, or wholly by the outer chamber 905. In some embodiments, the third chamber 1325 may also be heated by the heating element 915. The heat from the heating element 915 can serve to convert remaining liquid in vapor or steam.

In some embodiments, the third chamber 1325 may further comprise a third-chamber exit. 1340, as depicted in one embodiment in FIG. 9*a*. Steam may flow through the third chamber 1325 to and out the third-chamber exit 1325 and into a fourth chamber 1335.

The fourth chamber 1335 can be defined in a variety of ways. In one embodiment, as depicted in FIGS. 9*a* and 10*c*, the fourth chamber is defined by the union of the of the inner body 900 and the outer body 905. In this embodiment, the inner body further comprises a chamber bay 935, as depicted in FIG. 9*a*. And the outer body further comprises a chamber-attachment connection 1010, as depicted in FIG. 10*c*. When the inner body 900 is seated in the outer body 905, the chamber-bay 935 unites with the chamber-attachment connection 1010 to define the fourth chamber 1345. A sealing [not shown] can also be used to ensure that the fourth chamber 1335 is sealed at the chamber-bay connection. A gasket, adhesive or other sealing device known in the art may be used.

The fourth chamber 1335 comprise a fourth-chamber exit 1050, as can be seen in one embodiment depicted in FIG. 10*c*. The fourth-chamber exit 1050 is in fluid communication with the steam outlet 940. And steam from the fourth chamber may be discharged through the fourth-chamber exit 1050 to the outlet 940.

Figure 13A:
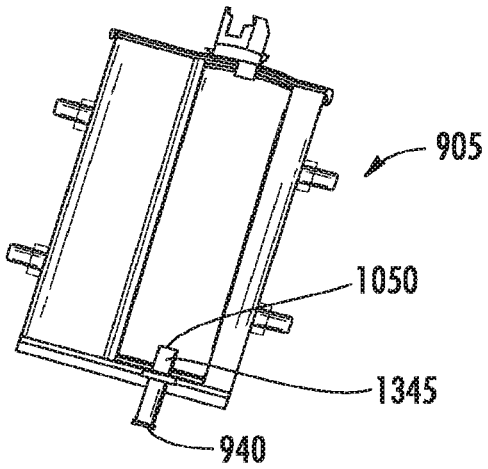
FIG. 13*a* is a cross-sectional view of the outer body in FIG. 13*a* showing a conduit extension.

In some embodiments, the fourth-chamber exit 1050 comprises a conduit extension 1345 extending from the outlet 940 into the fourth chamber 1345. One version of this embodiment is depicted in FIG. 13*a*. By extending into the fourth chamber, the conduit extension 1345 creates space between the fourth-chamber exit 1050 and outer body 905. This reduces the likelihood that particle buildup on the inside of outer body 905 encroaches on the opening of the fourth chamber exit 1050 and slows down or stops the flow of steam out of the steam outlet 940. In different embodiments, the length of the conduit extension 1045 may vary. But in some embodiments the length of the conduit extension 1045 is 5 mm.

The steam generators 10 disclosed herein can deliver a life expectancy of greater than 100 hours, or greater than 150 hours, or greater than 200 hours, or greater than 250 hours, or greater than 300 hours. In doing so, the steam generators 10 can pass greater than about 100 L of water, or greater than about 200 L of water, or greater than about 300 L of water, or greater than about 400 L of water, or greater than about 500 L of water through the inlet 16 and the outlet 26.

Although the disclosure has been described in detail with reference to several embodiments, additional variations and modifications exist within the scope and spirit of the disclosure as described and defined in the following claims.

What is claimed is:

1. A steam generator comprising:

a body having a first end and a second end;

a first and a second cover extending about the first and the second end of the body, respectively;

an inlet disposed about the first cover, the inlet configured to receive fluid into said body;

an outlet disposed about the second cover, the outlet configured to discharge steam from the body;

a plurality of pathways disposed within the body, the plurality of pathways comprising a first and at least a second pathway extending between the first end and the second end, the first pathway configured to receive fluid from the inlet and the second pathway is exposed to steam and is configured to output steam to the outlet;

a heating element in communication with the plurality of pathways, the heating element operable to increase the temperature of the fluid in the plurality of pathways so as to generate steam;

wherein the outlet includes a conduit that extends past an inner surface of the second cover and into the body such that at least a portion of the conduit is positioned in the second pathway.

2. The steam generator of claim 1, wherein the heating element is formed of an aluminum material.

3. The steam generator of claim 1, wherein the first pathway and the second pathway are on opposite sections of the body.

4. The steam generator of claim 1, wherein the plurality of pathways further comprises:

at least one auxiliary pathway that facilitates the flow of at least one of fluid and steam from the first end to the second end;

at least one return pathway to facilitate the flow of at least one of fluid and steam from the second end to the first end;

at least one connection pathway in fluid communication with at least one of the first pathway or the at least one auxiliary pathway to facilitate the flow of at least one of fluid and steam from the first pathway and the at least one auxiliary pathway to the at least one return pathway, the at least one return pathway being in fluid communication with the second pathway.

5. The steam generator of claim 4, wherein fluid traversing the plurality of pathways travels through the first pathway before traveling through the second pathway.

6. The steam generator of claim 1, further comprising a thermostat disposed about at least one of the first end and the second end, the thermostat configured to sense the temperature of at least one of the water and the steam.

7. The steam generator of claim 1, further comprising a first gasket disposed between the first cover and the first end of the body, and a second gasket disposed between the second cover and the second end of the body.

8. The steam generator of claim 1, wherein the second cover is formed integrally with the body.

9. The steam generator of claim 1, wherein the first cover is formed integrally with the body.

10. The steam generator of claim 1, wherein the first cover and the second cover are formed integrally with the body.

11. The steam generator of claim 1, wherein the body further comprises an inner body seated at least partially inside an outer body.

12. The steam generator of claim 11, wherein a diameter the inner body is greater than a diameter of the outer body, thereby resulting in a compression fit between the inner and out bodies.

13. The steam generator of claim 1, wherein the portion of the conduit that is positioned in the second pathway has a length of at least 5 mm from the inner surface of the second cover.

14. The steam generator of claim 1, wherein the plurality of pathways further comprise a plurality of vanes for guiding the at least one of fluid and steam though the plurality of pathways.

15. The steam generator of claim 14, wherein the vanes are configured to produce vortex motion as the at least one of fluid and steam traverses the plurality of pathways.

16. The steam generator of claim 1, wherein the portion of the conduit that is positioned in the second pathway has a length of at least 1 mm from the inner surface of the second cover.

17. The steam generator of claim 1, wherein the first cover is removably coupled to the body.

18. The steam generator of claim 1, wherein the second cover is removably coupled to the body.

19. The steam generator of claim 1, wherein the first cover and the second cover are removably coupled to the body.

* * * * *